United States Patent [19]

Ilsemann

[11] 4,201,027

[45] May 6, 1980

[54] DEVICE FOR INSERTING TAPE CASSETTES OR THE LIKE AND ENCLOSURES PARTICULARLY INTO HINGED BOXES

[76] Inventor: Heino Ilsemann, Wehkamp 3, 2800 Bremen, Fed. Rep. of Germany

[21] Appl. No.: 934,198

[22] Filed: Aug. 16, 1978

[30] Foreign Application Priority Data

Aug. 18, 1977 [DE] Fed. Rep. of Germany ..... 2737196
Aug. 2, 1978 [DE] Fed. Rep. of Germany ..... 2833862

[51] Int. Cl.[2] ..... B65B 57/06; B65B 43/39

[52] U.S. Cl. ..... 53/53; 53/564; 53/238; 53/253; 53/382

[58] Field of Search ..... 53/53, 564, 238, 253, 53/382

[56] References Cited

U.S. PATENT DOCUMENTS

| | | | |
|---|---|---|---|
| 3,507,088 | 4/1970 | Mizelle et al. | 53/53 |
| 3,517,477 | 6/1970 | Thornton | 53/53 |

*Primary Examiner*—Travis S. McGehee
*Attorney, Agent, or Firm*—Toren, McGeady and Stanger

[57] ABSTRACT

Device for inserting tape cassette or the like and enclosures particularly into hinged boxes, having devices for feeding the boxes, for opening the boxes, for feeding and inserting the cassettes and enclosures into the open boxes and for closing and pushing out the filled boxes and having a revolving head with holding devices for the boxes. The holding devices for the boxes are arranged at the periphery of the horizontally revolving head and the holding devices hold the boxes tangentially to the periphery of the revolving head. The axis of rotation extends horizontally from the cover and bottom of the boxes and is directed tangentially to the periphery of the revolving head. The holding devices have non-stationary devices rotating together with the revolving head for opening and closing the boxes during the rotation of the revolving head. Moreover, in the opening region of the slide-in cover of each hinged box, there is provided a microswitch which can be actuated when opening the slide-in cover and which controls the cassette insertion and/or a device for pushing out rejects.

9 Claims, 4 Drawing Figures

DEVICE FOR INSERTING TAPE CASSETTES OR THE LIKE AND ENCLOSURES PARTICULARLY INTO HINGED BOXES

FIELD OF THE INVENTION

The invention relates to a device for inserting tape cassettes or the like and enclosures particularly into hinged boxes, having devices for feeding the boxes, for opening the boxes, for feeding and inserting the cassettes and enclosures into the open boxes and for closing and pushing out the filled boxes, and having a revolving head with holding devices for the boxes.

BACKGROUND OF THE INVENTION

Devices of this type to pack cassettes, such as, compact cassettes, or also video cassettes and associated enclosures, particularly of cardboard or paper, particularly into hinged boxes, particularly of plastic are known.

In a known device of the above-mentioned type, this is carried out, for example, in that the boxes are guided on a chain in a straight line past the various stationary handling stations. The chain stops each time one of the holding devices for the boxes arranged in a uniform spacing on the chain reaches one of the handling stations which again are arranged at equal distances from the chain. While the chain is stopped, the respective working steps are performed, such as, inserting boxes into the holding devices, opening the boxes, inserting the enclosures, inserting the cassettes, closing the filled boxes and discharging the boxes.

Aside from the extreme space requirement of this device which is determined by the linear transport of the boxes, it is a disadvantage in this known device of the above-mentioned type that the number of work cycles is low due to the multitude of the stationary working devices.

The present invention, therefore, is based on the task of avoiding the disadvantages of the known device and, particularly, is directed toward a device of the above-mentioned type which operates reliably and quickly with a high number of work cycles and requires less space and is less expensive to manufacture than the known devices.

SUMMARY OF THE INVENTION

The task is solved according to the invention by a device for packing tape cassettes or the like and enclosures particularly into hinged boxes which device is characterized by a revolving head with holding devices for holding, opening, and closing the boxes.

By means of the features provided according to the invention, not only is the space requirement reduced, since, contrary to the previous devices, no longer holding devices for the revolving and returning portion of the transport chain must be present in addition to the holding devices corresponding to the number of stationary stations, but the number of holding devices for the boxes corresponds to the number of the stationary working stations. Additionally, the total number of the stationary working stations is reduced because opening and closing the boxes is carried out during their further transport from one station to the next, while in the devices that have become known heretofore, separate stationary stations are provided for this purpose. Compared to the heretofore known devices, it was particularly possible to reduce the manufacturing price to about two thirds.

According to a preferred embodiment of the present invention, it is provided that the pitch of the screw is zero degrees over a partial angular range, that within this range, the drive shift of the revolving head connected to a worm gear stands still and the boxes are located at assigned stations. Further, during a rotation over the remaining angular range of the screw, the gearing shifts the revolving head from one station to the next. In the angular portion, in which idle operation of the index drive is effected, the pitch of the screw is 210° and in the range in which the revolving head is shifted from one station to the next, the pitch is 150°. The chosen ratio in the screw, angular portion for idling and angular portion for further transport, makes it possible to achieve an optimum quiet running of the machine at a high number of cycles of up to more than 75 cycles/-minute.

Another preferred embodiment of the invention is distinguished by the fact that a station for pushing out rejects is provided. The station for pushing out rejects is arranged between the feeding device for the cassettes and the enclosures and the normal push-out station. By individually pushing out boxes which are deposited upside down or which cannot be opened because of clamping, a continuous operation of the device is achieved which is particularly important when the device is linked to other machines, for example, machines for packing the boxes for shipping, etc. Without this feature, the device would have to be stopped in case of this kind of trouble and the trouble, or the box deposited upside down, would have to be removed manually.

Other preferred embodiments of the present invention provide that the box is fixed between two jaws and that one of the jaws is stationary while the other is spring-loaded. Thus, it is possible to compensate for tolerances in the dimensions of the boxes.

Another embodiment of the invention is distinguished by the fact that the flap is provided with a cam which cam closes the cover of the box when the flap is swung upwardly. As a result, those cassettes are pressed back into the box which possibly project out of the box when enclosures of cardboard that are too stiff have pushed out the cassettes; thus, closing of the box is always ensured.

According to another preferred embodiment of the present invention, it is provided that, between the box on the one hand and enclosures and cassettes on the other hand, there is provided a mouthpiece for insertion, The mouthpiece for insertion has, at its upper side, a rotatably supported spring plate. By means of the mouthpiece, the cassette including the enclosure can be safely inserted into the box when in the holding device, whereby the rotatably supported spring plate prevents the cassette from striking the short cover side during insertion. Futhermore, another embodiment of the invention provides that the flap of the holding device has at its end a rotatably supported spring structure which can be rotated about the front edge of the cover of the box. This prevents the cassette from striking the long bottom side of the cover during insertion.

Another preferred embodiment of the inventive device is distinguished by the fact that in the opening region of the slide-in cover, opening away from the housing of each hinged box, there is arranged a microswitch which can be actuated when the slide-in cover opens and which controls the cassette insertion and/or the station for pushing out rejects.

In this connection, a microswitch is generally understood to be a contact or proximity switch which is switched over a small range, for example, in the submillimeter range, whereby the switching procedure in the proximity switch takes place without contact.

When the microswitch is switched upon the opening of a box, this signal is transmitted to the cassette inserting device so that, indeed, a cassette is inserted. Accordingly, the signal prevents the station for pushing out rejects to be actuated when this cassette passes by. If, for some reason, for example, thus to clamping or incorrect positioning of the boxes, a box cannot be opened, the appropriate and necessary switching procedure of the microswitch is not actuated so that an insertion of a cassette is prevented, automatic pushing out of the respective box is carried out by the station for pushing out rejects when the box has arrived in this station. Of course, additional working stations can be provided if necessary.

An especially preferred embodiment of the invention is distinguished by the fact that the microswitch can be actuated by the a spring-loaded pawl which is pressed upwardly by the cover when the covers of the boxes are opened.

Additional features and advantages of the invention result from the claims and from the following description, wherein embodiments are explained in detail with the aid of the drawings. Ih the drawing:

DESCRIPTION OF THE PREFERRED EMBODIMENTS

Figure 1:
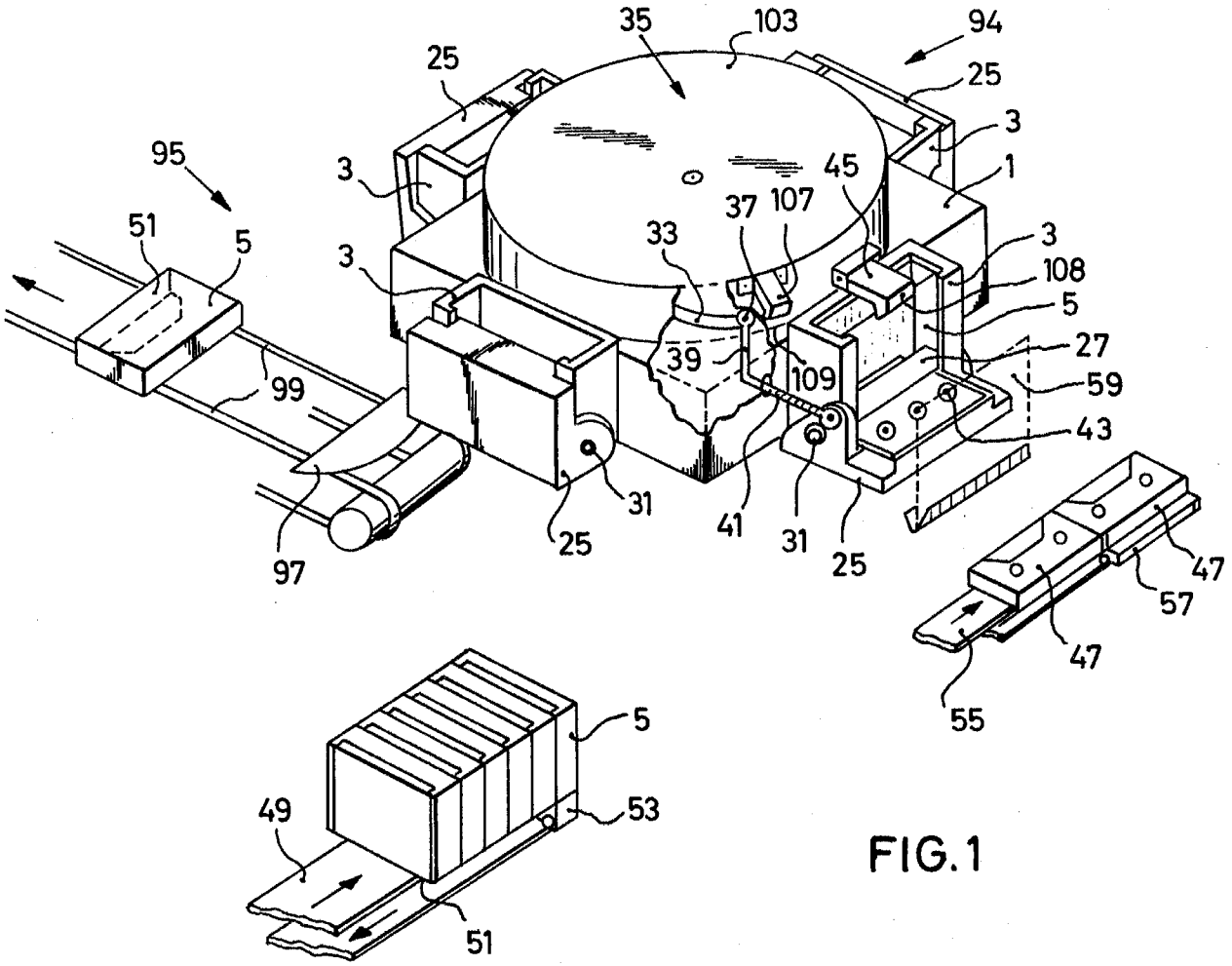
FIG. 1 shows a partial section of the inventive revolving head and the inventive cam disc, and removed feeding and removing devices.
Figure 2:
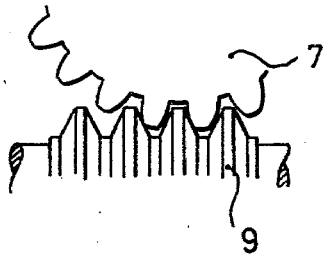
FIG. 2 shows a portion of the gearing for driving the revolving head with that portion of the screw that has no pitch.

A revolving head 1 is the central portion of the inventive device for packing music cassettes and enclosures into hinged boxes. In the shown embodiment, four holding devices 3 for the boxes 5 are arranged at the revolving head. The revolving head 1 is rotatably supported and is driven through a step gearing. The gearing operates similarly to a worm gearing and the revolving head is connected rigidly to the worm gear 7 which interacts with a screw 9 having a variable pitch. Through an angular range of, for example, 210°, the pitch of the screw 9 is zero, so that the drive shaft of the revolving head 1 stands still as long as the worm gear 7 interacts with this portion of the screw 9. During this time, the holding devices 3 are assigned to the corresponding working stations, so that, simultaneously, the corresponding functions are carried out (described in detail hereinbelow). Over a range of 150° of the screw 9, the revolving head 1 is driven so that the gearing shifts the holding devices from one station to the next, whereby, in the present embodiment, a rotation of the head by 90° is effected. The total rotation of the screw corresponds to a rotation of the main shaft during which a working cycle of the machine is carried out.

Figure 3:
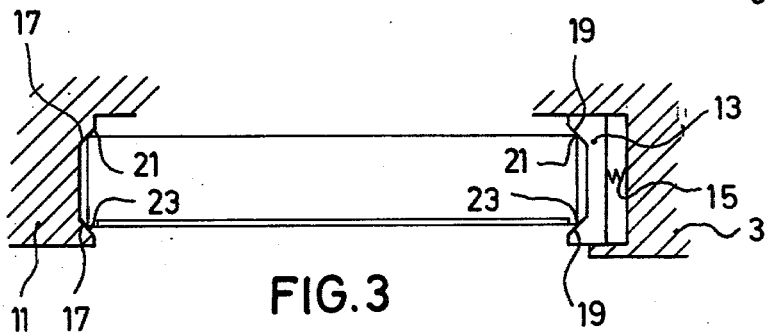
FIG. 3 shows the holding jaws for the box.

The box 5 is fixed in the holding devices 3 by means of two jaws 11, 13 (see FIG. 3). The jaw 11 of the holding device 3 is fixedly connected to the holding device 3, if necessary, in one piece, whereas the jaw 13 is arranged resiliently sliding by means of springs 15 in the direction towards the fixed jaw 11. Thus, tolerances in the dimensions of the boxes are compensated. The jaws 11, 13 have sections 17, 19 which form an angle of approximately 90° relative to each other and the sections 17, 19 each form an angle of approximately 45° with the side surfaces of the box; as a result, the contact of the sections 17, 19 with the box 5 takes place only linearly along four edges 21, 23 of the box 5. This primarily ensures that the narrow sides of the boxes will not be scratched. The tension of the spring 15 is adjusted in such a manner that the box 5 is held evenly. At the opening for insertion of the boxes 5 between the jaws 11, 13 of the holding device 3, the jaws 11, 13 have radii for sliding-in (not shown) that are so large that the boxes 5 can be inserted reliably and without clamping.

The holding devices 3 for the boxes each have a flap 25 which is pivotally supported in 31 in alignment with the points of rotation 27 about which the cover 29 of the box 5 is opened.

The flaping motion, particularly opening and closing the flap 25, is carried out mechanically through a control cam which is located in a cam disc 35 which is fixedly mounted above the revolving head 1. The control cam 33 is constructed as a pot-shaped cam of the cam disc 35, so that the controlling movement takes place in a forced manner. The controlling movement is transmitted from the control cam 33 to the flap 25 through a curved roller 37 running in the control cam 33 and through a curved lever 39 and a pull rod 41.

In another embodiment, the control cam could also be constructed as a shoulder in the cam disc 35 whereby the curved roller would then be resiliently pulled towards the shoulder of the control cam.

The flap 25 has vacuum-operated suction devices 43 which are placed, before the flap 25 is opened, on the cover 29 of a box which is inserted in the holding device 3 and slide on the cover 29 of the box 5 by means of the vacuum when the flap 25 is opened.

At the holding device on the right hand side in FIG. 1, there can be seen a spring-loaded pawl 45 by means of which those cassettes 47 are pressed back into the box which, during closing, project out of the cover 29 of the box 5 and have been pressed out, for example, by the back-pushing action of strong cardboard enclosures. This ensures the closing of the box 5.

The boxes are fed to the holding devices 3 of the revolving head 1 through a conveyor belt 49. The boxes are placed on the belt with the narrow side 51 of their cover 29, whereby the opening direction of the cover 29 is directed against the direction of conveying (see FIG. 1). The conveyor belt 49 is advantageously provided with a smooth cover of nylon foil to avoid scratches in the boxes. The speed of the belt can advantageously be controlled throu,h a direct-current drive with Thyristor-control, so that the speed of feeding the boxes 5 can be adjusted exactly to the adjusted number of cycles of the revolving head 1. In this manner, when the number of cycles of the revolving head 1 is reduced, an unnecessary slip between conveyor belt 49 and box 5 resulting from a conveyor belt speed which is too high is avoided.

Since, for a safe insertion of the boxes by means of a sliding member 53 into the holding devices 3, a certain pressure must be exerted onto the box to be inserted, a pressure control means (not shown) is provided. This pressure control means interrupts the inserting procedure when the number of boxes 5 in front of the inserting device is less than a predetermined number of boxes 5; as a result, the revolving head 1 will continue to rotate without picking up a box 5.

The cassettes 47 are also fed to the revolving head on a conveyor belt 55. The cassettes 47 are arranged on the belt with their tape side facing towards the revolving head 1. The cassette 47 to be inserted is pushed onto an intermediate plate 57 as a result of the pressure acting on the cassettes on the conveyor belt 55. By means of a sliding member (not shown), the cassettes 48 are transversely moved from the intermediate plate 57 into the cover 29 of the box 5 which is in the holding device 3 in the opened position, the cover 29 being level with the cassett 47. The pressure necessary for the next cassette 47 to follow is controlled by means of a switch (not shown).

Figure 4:
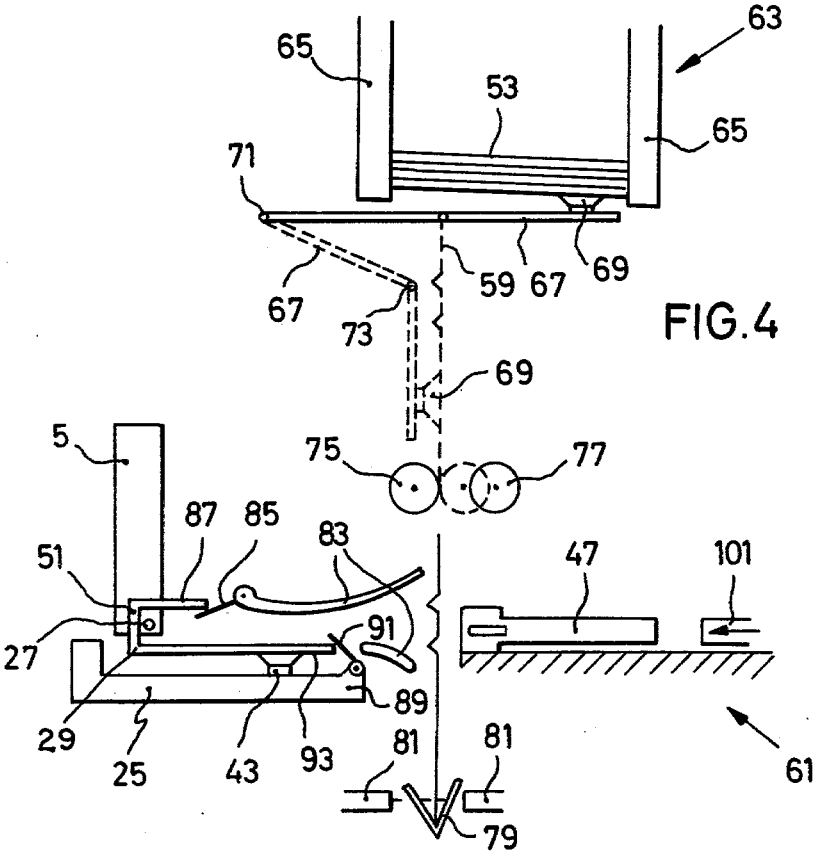
FIG. 4 shows sections of the feeding device for enclosures and the device for inserting cassettes and enclosures.

A feeding device for enclosures 59 to be inserted into the boxes 5 together with the cassettes 47 and the device for inserting the cassettes 47 and 59 is shown in detail in FIG. 4.

Above the inserting device 61 for the cassettes 47 and the enclosures 49, there is arranged a stacking tower 63 for the enclosures 59. The angle sections 65 for holding the enclosures 59 are arranged adjustably in order to compensate for tolerances in the size of the enclosures 59. Below the stacking tower, there is arranged a double-hinged suction arm 67 which is equipped with suction members 69. The suction members 69, when making contact with the lowermost enclosure 59 in the stacking tower 63, are joined to the lowermost enclosure 59 after an application of vacuum and pull out the lowermost enclosure 59 from the stacking tower 63 during the pivoting movement of the suction arms 67.

The two hinges 71 and 73 of the suction arms 67 have the purpose to bring, by a two-fold movement of the suction arms 67, the enclosure 59 into a vertical position between two rollers 75 and 77 which rotate in opposite directions and above the clearance between the intermediate plate 57 for the cassettes 47 and the box 5. The two rollers 75 and 77 are both driven and their directions of rotation are directed downwardly in order to convey the enclosures 59. The roller 77 is coated with plastic. During pivoting the enclosure 59 by means of the suction arm 67, the roller 77 is moved laterally away from the roller 75 so that a wide clearance is created between the rollers 75 and 77. When the roller 77 is moved back towards the roller 75 and, simultaneously, when the vacuum in the suction members 69 of the suction arm 67 is switched off, the enclosure 59 is grasped between the rollers 75 and 77 and is conveyed into a vertically adjustable collecting basket 79 arranged below the rollers, the collecting basket 79 being adjustable particularly from the outside without having to remove a protective cover.

At the collecting basket 79, there is provided a photocell arrangement 81 by means of which it can be checked whether or not an enclosure 59 has been grasped and has been placed in the collecting basket 59.

In FIG. 4, an inserting mouthpiece 83 is swung in front of the opened cover 29 of the box 5. The mouthpiece 83 pushes the cassette 47 together with the enclosure 59 into the cover 29 of the box 5. At its upper side, the mouthpiece 83 has a rotatably supported spring plate 85 which is directed toward the box 5 and which prevents that a cassette 47 is pushed during inserting against the short side 87 of the cover 29. At the upper or forward end of the flap 25 of the revolving head 1, there is arranged a similar rotatably supported spring construction 91 (for clarity's sake not shown in FIG. 1) which prevents the cassette 47 from being pushed against the front edge 93 of the cover 29. The inserting mouthpiece 83 is pivotally supported and is swung upwardly by means of a cam disc (not shown) before the revolving head 1 continues to rotate.

As a third working station, there is provided a station 94 for pushing out rejects in which those boxes 5 are pushed out which are placed upside down in the holding device 3 of the revolving head 1 or which cannot be opened because they are clamped into the holding device 3. The boxes are pushed out by means of a sliding member. The further transport is carried out in a similar manner as for the filled boxes in the normal pushing-out station 94. Therefore, the transport of the boxes 5 ejected by the station 94 for pushing out rejects is not further discussed herein.

At the normal pushing-out station 95, the filled box is pushed out of the jaws 11, 13 of the holding devices 3 of the revolving head 1. Below the holding device 3 which is in the normal pushing-out station 95, there is arranged a curved chute 97 along which the pushed-out boxes 5 slide onto a double belt 99 which extends perpendicularly to the conveyor belt 49 of the inserting device for the boxes. The double belt 99 consists of two round belts which are driven by a separate drive.

Laterally to a stationary cover 103 of the control cam 33 controlling the sequence of movment, there is arranged a microswitch 107 whose lower end 109 is arranged, as shown in the holding device 3 directed toward the right hand side, slightly above a spring-loaded pawl 45 which passes by the microswitch 107, so that the microswitch 107 can be switched by a slight lifting of the pawl 45 during the time period in which the pawl 45 passes under the microswitch 107.

According to another embodiment, the spring-loaded pawl 45 could be provided in its housing support 106 with a microswitch and could be coupled to this microswitch, so that the microswitch is also switched when the front portion 108 of the pawl 45 is slightly lifted. The pawl 45 can be rotated toward its loading spring (not shown) only by a limited angular range. In a position in which the lower edge of the pawl 45 slightly projects into the box beyond the inner side of the wall 30 of the box 5 facing towards the pawl, the front end 108 of the pawl 45 can be pivoted until it reaches the outer side of the wall so that the cover 29 of the box 5 can be opened and closed while pushing aside the pawl 45.

When there exists a signal which indicates that the box 5 is opened, the microswitch 107, which is actuated by the pawl 45 when a box 5 is opened, effects an insertion of a cassette 47 into the corresponding box 5 when the latter has reached the cassette-inserting station; however, when such an opening signal does not exist, the microswitch 107 does not effect an insertion of a cassette 47 or prevents such an insertion.

The microswitch 107 actuated by the pawl 45 furthermore is connected to the station 94 for pushing out rejects by means of which, when there does not exist a switching signal actually to be effected by the microswitch 107 when the box 5 is opened, the respective unopened boxes are rejected after the respective holding device 3 has been moved into the station 94 for pushing out rejects. That is, boxes are ejected which have been placed upside down in the holding device 3 of the revolving head or cannot be opened because they are clamped into the holding device 3. In this case, the boxes 5 are pushed out by means of a sliding member (not shown) which is controlled by the microswitch 107. After being ejected from the station 94 for pushing out rejects, the ejected boxes fall into a collecting point from where they can be removed, for example, by hand and can be placed correctly on the conveyor belt to be used once again.

The inventive device for packing compact cassettes and enclosures into hinged boxes operates as follows:

Through the conveyor belt 49, the empty boxes 5 are fed to the revolving head 1. The first box 5 is pushed from below by means of a sliding member 53 between the jaws 11, 13 of the holding device 3. Subsequently, the revolving head 1 begins to rotate as the screw 9 of the shift gearing with its increasing peripheral portion extending over 150° acts on the worm gear 7. In doing so, the flap 25 of the holding device 3 which was slightly opened when the box 5 has been inserted, is pulled back completely, so that the suction members 43 of the flap 25 come into contact with the cover 29 of the box 5; simultaneously, vacuum is applied to the suction members 43. The flap 25 is moved upwardly by means of the suction members 43 toward the cover 29 of the box 5 so that the control cam 33 of the cam disc 35 extends slightly inwardly at this location in respect to its circumference, and so that the curved roller 37 extends inwardly in the control cam 33 and pulls upwardly the pull rod 41 which is connected to the flap 25 through the curved lever 39.

During the following sequence of movements, the flap 25 is opened completely by 90° as the curved roller 37 now runs in a portion of the control cam 33 which is, in respect to circumference, directed outwardly. By means of the vacuum applied to the suction members 43, during opening of the flap 25 also the cover 29 of the box 5 is opened. At the inserting device 61, the flap 25 and, thus, the cover 29, are completely opened.

During opening of the cover 29 of the box 5, the cover 29 slightly lifts the pawl 45 when passing through the region 37 of the microswitch 107, whereby the microswitch 107 is switched and transmits a signal to the station 94 for pushing out rejects which signal makes the latter inoperative when passing by the respective holding device 3, so that the corresponding box 5 after being filled can travel past the not-actuated station 94 into the normal pushing-out station 95.

However, when during operating the flap 25 a cover 29 of a box 5 is not taken along and, thus, the box 5 is not opened between the time the boxes are inserted and the time the cassettes including enslosures are inserted (this procedure shall be described hereinbelow), then also the microswitch 107 actuated by the pawl 45 is not switched, so that the station 94 for pushing-out rejects is actuated at the appropriate time and pushes the corresponding box 5 out of the holding device 3. Accordingly, when an opening signal does not exist because the pawl 45 is slightly lifted by the cover 29 of the box 5, the inserting station for the cassettes 47 is not actuated, so that the respective holding device merely passes by the inserting station for the cassettes 47.

At the same time, as the box 5 is opened, a vacuum is applied to the suction members 69 of the suction arm 47 which is in the swung-up position. As a result of the two-fold pivoting movement of the suction arm 47, an enclosure 59 is pulled out of the stacking tower 63 and is placed vertically between the rollers 75 and 77 which, after the roller 77 has been moved inwardly, convey the enclosure 59 into the collecting basket 79. Furthermore, the mouthpiece 83 is moved in front of the opened cover 29.

Subsequently, after the photocell arrangement 81 has determined that there is an enclosure 59, the cassette 47 resting on the intermediate plate 57 is pushed by means of the sliding member 101 toward the enclosure 59 and, while folding the enclosure 59, is pushed through the mouthpiece 83 into the cover 29 of the box 5. When the photocell arrangement 81 determines that there is no enclosure in the collecting basket 79, the sliding member 101 is not actuated. In the following cycle, after closing the box 5, the latter is ejected at the following station for pushing out rejects.

The filled cover is then again moved into a vertical position and the box 5 is closed during this movement as the curved roller 37 in the control cam 33 travels, in respect to circumference, inwardly in the cam disc 35 and, thus, closes the flap through the curved lever 39 and the pull rod 41. The cover 29 is completely pressed against the bottom part of the box 5 by means of a cam which is not shown. A cassette 47 which possibly projects out of the cover 29 of the box 5, due to the back-pushing action of enclosures 59 that are too stiff, is pressed into the cover 29 of the box 5 by means of the pawl 45, so that the box 5 can be securely closed.

If a properly filled box is in the holding device at the station 94 for rejecting rejects, the latter is no longer actuated and, in the next work cycle, the holding device 3 holding the properly filled box 5 is moved to the normal pushingout station 95. At this station, the box is pushed by means of a sliding member (not shown) out of the holding device 3 in a downward direction and slides over the chute 97 onto the double belt 99 which conveys the box to further working stations, possible to a packing station.

Of course, in another embodiment, the boxes 5 can be pushed from the jaws 11, 13 of the revolving head 1 over a chute 97 onto a conveyor belt which is arranged alongside the feed direction of the boxes and which conveys the boxes 5 in a longitudinal direction. In this case, conveying preferably is carried out by means of a flat belt having its own drive.

In another embodiment, stacking the boxes can be carried out by omitting the chute 97 and pressing the boxes 5 from the holding device 3 of the revolving head 1 onto a plate and by subsequently pushing out the boxes through lateral brushes onto a table.

In connection with this stacking procedure, an entire stack with a desired amount 10, 15 or another number of boxes can be moved transversely by means of a pneumatic cylinder.

The features of the invention disclosed in the above description, in the drawings and in the claims can be essential for individually or in any combination realizing the invention in its various embodiments.

I claim:

1. A device for inserting tape cassettes or the like and enclosures into hinged boxes, comprising:

(a) a revolving head having a drive shaft and a vertical axis of rotation and capable of being turned in a step-wise manner by means of work gearing;

(b) said worm gearing including a worm gearing portion, which is rigidly connected to the drive shaft of said revolving head, and also including a continuously driven screw which is in engagement with said work gear portion and whose pitch is zero along a first angular range, preferably of 210°, and whose pitch is different from zero along a second angular range, preferably 150°;

(c) four holding devices being arranged at the periphery of said revolving head which are angularly offset relative to each other by 90°, said holding devices each serving to receive a hinged box;

(d) each holding device having two vertically arranged holding jaws for grasping the short narrow sides of one hinged box having a cover in such a manner that the hinged box is arranged with its plane tangential relative to said revolving head and with the axis of rotation of its cover at the bottom, and a flap with a vacuum suction member, which flap is rotatably supported so as to be in alignment with points of rotation of said cover or with the axis of rotation;

(e) a stationary cam disc with a control cam is arranged parallel to the plane of rotation of said revolving head and concentrically thereto, in which curved rollers engage which are assigned to each holding device and are arranged on said revolving head and which, by means of a curved lever and a pull rod connected thereto which are arranged on said revolving head, open or close the flap of the respective holding device depending on the angular position of said revolving head;

(f) the revolving head having a periphery, opposite which, are arranged in a stationary manner and always offset by 90°, a box inserting station, a cassette inserting station, a station for pushing out rejects and a normal pushing-out station; said box inserting station having a conveyor belt for feeding empty hinged boxes in an upright position in which they stand on a narrow side of the cover and in which the folding direction for opening said cover is directed away from said revolving head, and having a sliding member for inserting always one box into a holding device of said revolving head, which holding device is located opposite said box inserting station; said cassette inserting station having a conveyor belt for supplying said cassettes in a position in which they are lying on said conveyor belt in such a way that the long narrow side of the tape of the cassette is facing towards said revolving head, having a stacking tower which is arranged above the travel path of the supplied cassettes and assigns an enclosure to each cassette to be inserted, and devices for always inserting a cassette and an enclosure into an open box which is located in a holding device of said revolving head, said holding device being arranged opposite said cassette inserting station; said station for pushing out rejects having a keying device for checking whether a filled box can be opened which is arranged in a holding device of said revolving head, which holding device is located opposite said pushing-out station for pushing out rejects and with a sliding member for ejecting those boxes from the respective holding device which cannot be properly opened; said normal pushing-out station having a sliding member for pushing out from the respective holding device a filled cassette which is arranged in the flat holding device of said revolving head which is positioned opposite said normal pushing-out station and having a device for conveying away the ejected, filled hinged boxes; and wherein a complete rotation of the driven screw of said worm gearing corresponds to a 90° rotation of the drive shaft of said revolving head and, thus, to a work cycle, wherein, in the first partial angular range of said screw in which its pitch is zero, a holding device each is arranged in a stationary manner opposite each of the box inserting stations, the cassette inserting station, the station for pushing out rejects and the normal pushing-out station, and in the second partial angular range of said screw in which its pitch is different from zero, further rotation of said revolving head takes place so that the several holding devices are moved ahead toward the respective subsequent station.

2. A device according to claim 1, said holding jaws of each holding device have, for fixing said boxes on said revolving head, inclined, polished portions which act on the corner edges of the short narrow sides of said boxes in a linear manner, one of said jaws being arranged stationary on said revolving head and the other jaw being movably arranged on said revolving head in a spring-loaded manner; said jaws being chrome-plated; and said jaws having large radii for insertion in the direction of inserting said boxes.

3. A device according to claim 1 or 2, wherein the control cam of said cam disc is a pot-shaped curve; and said cam disc has a unilateral control shoulder against which said curved lever is pressed by means of a spring.

4. A device according to claim 1, wherein in the flap to whose vacuum suction member a vacuum is applied during the rotation of said revolving head for opening or closing said boxes is provided with a cam which closes said cover of said box when said flap is swung upwardly; and wherein, in each holding device above said box there is provided a spring-loaded pawl for pressing down said cassette when said cover of said box is provided with said cassette and the respective enclosure is closed.

5. A device according to claim 1, wherein said stacking tower for said enclosures is constructed so as to be adjustable toward all sides; further, for transferring said enclosures from said stacking tower into the travel path of said cassettes, in the travel path of said cassettes there are provided a suction arm which has two hinges and suction members to transport rollers, one of said rollers being movably supported, and an adjustable collecting basket for temporarily receiving said enclosures; between said box to be filled, on the one hand, and said enclosures and said cassettes on the other hand, there is arranged an inserting mouthpiece at whose upper side there is provided a rotatably supported spring plate; and said flap of each holding device has at its free end a rotatably supported spring construction which, to facilitate the insertion of said cassettes and said enclosures, can be pivoted about the front edge of said cover of said box.

6. A device according to claim 1, wherein, in the opening region of said cover of said hinged box supported by said holding device, a microswitch is arranged which can be actuated when said cover is opened and which controls the insertion of said cassette into said cassette inserting station and/or the ejection of defective boxes in said station for pushing out rejects, said microswitch being actuated during the opening of said cover by means of a spring-loaded pawl which is pressed upwardly by said cover.

7. A device according to claim 6, wherein a microswitch is arranged at each holding device on said revolving head.

8. A device according to claim 6, wherein a stationary microswitch is arranged in front of said cassette inserting station in the opening region of said cover.

9. A device according to claim 6, wherein said microswitch can be actuated after opening said cover when said box is enclosed once again after said cassette and said enclosures have been inserted in said cassette inserting station.

* * * * *